United States Patent [19]

McGourty et al.

[11] Patent Number: 4,595,305

[45] Date of Patent: Jun. 17, 1986

[54] RIBBON CASSETTE

[75] Inventors: Thomas K. McGourty; Lawrence F. McGourty, both of Pas Robles, Calif.

[73] Assignee: Varitronic Systems, Inc., Minneapolis, Minn.

[21] Appl. No.: 761,297

[22] PCT Filed: Jan. 20, 1984

[86] PCT No.: PCT/US84/00097

§ 371 Date: Feb. 17, 1984

§ 102(e) Date: Feb. 17, 1984

[87] PCT Pub. No.: WO85/03260

PCT Pub. Date: Aug. 1, 1985

Related U.S. Application Data

[63] Continuation of Ser. No. 592,018, Feb. 17, 1984, abandoned.

[51] Int. Cl.[4] ..... B41J 35/28

[52] U.S. Cl. ..... 400/208; 400/249

[58] Field of Search ..... 400/194, 195, 196, 196.1, 400/207, 208.1, 208, 249; 242/197; 33/172 F

[56] References Cited

U.S. PATENT DOCUMENTS

| | | | |
|---|---|---|---|
| 1,090,128 | 3/1914 | Avers | 400/249 X |
| 3,604,549 | 9/1971 | Caudill et al. | 400/208 |
| 3,632,052 | 1/1972 | Read | 242/67.4 |
| 3,643,779 | 2/1972 | Anderson et al. | 400/208 X |
| 3,691,921 | 9/1972 | Isbell | 242/197 X |
| 3,804,227 | 4/1974 | Cappotto et al. | 400/208 |
| 3,814,231 | 6/1974 | Cappotto | 400/196.1 X |
| 3,897,866 | 8/1975 | Mueller | 400/196.1 X |
| 3,994,383 | 11/1976 | Best | 400/196.1 |
| 4,083,444 | 4/1978 | Salto | 400/208 |
| 4,140,407 | 2/1979 | Porterfield et al. | 400/208 X |
| 4,210,403 | 7/1980 | Mazouet et al. | 400/196.1 |
| 4,239,399 | 12/1980 | Johnstun | 400/128 |
| 4,388,006 | 6/1983 | Waibel | 400/208 X |
| 4,402,619 | 9/1983 | Paque et al. | 400/208 X |
| 4,413,919 | 11/1983 | Applegate et al. | 400/208 |
| 4,419,175 | 12/1983 | Bradshaw et al. | 156/554 |

FOREIGN PATENT DOCUMENTS

| | | | |
|---|---|---|---|
| 2157919 | 6/1973 | Fed. Rep. of Germany . | |
| 800638 | 8/1958 | United Kingdom . | |
| 1455915 | 11/1976 | United Kingdom | 400/208 |

*Primary Examiner*—Edgar S. Burr
*Assistant Examiner*—Charles A. Pearson
*Attorney, Agent, or Firm*—Merchant, Gould, Smith, Edell, Welter & Schmidt

[57] ABSTRACT

A film ribbon cassette for an impact printer is disclosed. The cassette includes two compartments (430 and 432) divided by a central wall (434). A central shaft (482) extends from compartment (432) into the other compartment where it receives a motor drive (486). The shaft is attached to a knurled roller (472) which draws the ribbon from the supply spool (438) through a member (436) across an aperture for a printing station, crossing over and returning to the other side of the cassette into the spent ribbon compartment (432).

2 Claims, 6 Drawing Figures

RIBBON CASSETTE

This is a continuation of application Ser. No. 592,018, filed Feb. 17, 1984, now abandoned.

TECHNICAL FIELD

This invention relates generally to a ribbon cassette or cartridge for use in connection with printing or typing equipment using a pressure process to transfer dry film impressions onto an image carrying tape.

CROSS REFERENCE

This application hereby incorporates by reference the disclosures of our co-pending applications filed on even date herewith with the following titles:

Precision Tape Feed and Guide Mechanism, Ser. No. 587,184

Print Disk Positioning System, Ser. No. 584,434

Printing Mechanism, Ser. No. 608,050

Tape Cassette with Supply Indicator, Ser. No. 598,554

Electronic Tape Writing Machine, Ser. No. 587,318

BACKGROUND OF THE INVENTION

In the field of commercial art, there is a significant need for a simple means of transferring prefabricated letters or characters to a "pasteup" sheet for later photographing or printing. A dry rub-on transfer letter process is well known, however, these materials are supplied in sheets and must be carefully aligned to produce acceptable images. Machines were later developed which prepared such letters on a continuous tape. This solved many of the problems in the prior art. Such a machine is shown in PCT Publication WO 82/03600.

One of the problems with this technology is that the pigment carried by the ribbon or film transfers very easily upon touch and may be damaged by scratching, bending, etc. so that, during the transfer process, a portion of the character printed may be lacking in pigment, thus destroying the job. Therefore, it is essential that a device which holds and supplies the ribbon to the printing station be capable of delivering the ribbon continuously and without damage. Furthermore, it is essential that the ribbon be easy to install within the machine without the user touching the ribbon so as to maintain clean hands. Finally, a convenient method of disposing of spent ribbon would be desirable since, again, touching the ribbon is quite messy.

The present invention overcomes the above-stated problems in the prior art by providing a simple and highly effective cassette for handing film or ribbon through the print station and provides for disposal thereof after use.

SUMMARY OF THE INVENTION

The invention is generally directed to a film ribbon cassette for use in an impact printer, the cassette having a casing with three spaced apart generally parallel walls and a top and bottom wall defining first and second compartments divided by the middle of the three parallel walls, a plurality of coaxially aligned apertures through the parallel walls, a shaft extending through two adjacent parallel walls into both compartments, the shaft including means for attachment to a rotary drive, a first supply reel in the first compartment for supplying unused film, the reel having a central bore which bears upon the shaft means for guiding film from the supply reel in the first compartment to the second compartment, a pinch roller in the second compartment biased against the shaft for pulling spent ribbon to the second compartment when the shaft is turned, whereby film on the supply reel is drawn into the second compartment when the shaft is turned.

According to a further aspect of the invention, a ribbon supply sensor is provided within the first compartment to indicate the extent of film supply remaining.

According to another aspect of the invention, means are provided for stripping the spent film from the roller in the second compartment as it passes the shaft.

Various advantages and features of novelty which characterize the invention are pointed out with particularity in the claims annexed hereto and forming a part hereof. However, for a better understanding of the invention, the advantages and objects obtained by its use, reference should be had to the drawings which form a further part hereof and to the accompanying descriptive matter in which there are illustrated and described certain preferred embodiments of the invention.

BRIEF DESCRIPTION OF THE DRAWINGS

In the drawings, wherein like numerals refer to like elements throughout the several views.

DETAILED DESCRIPTION OF THE INVENTION

Figure 1:
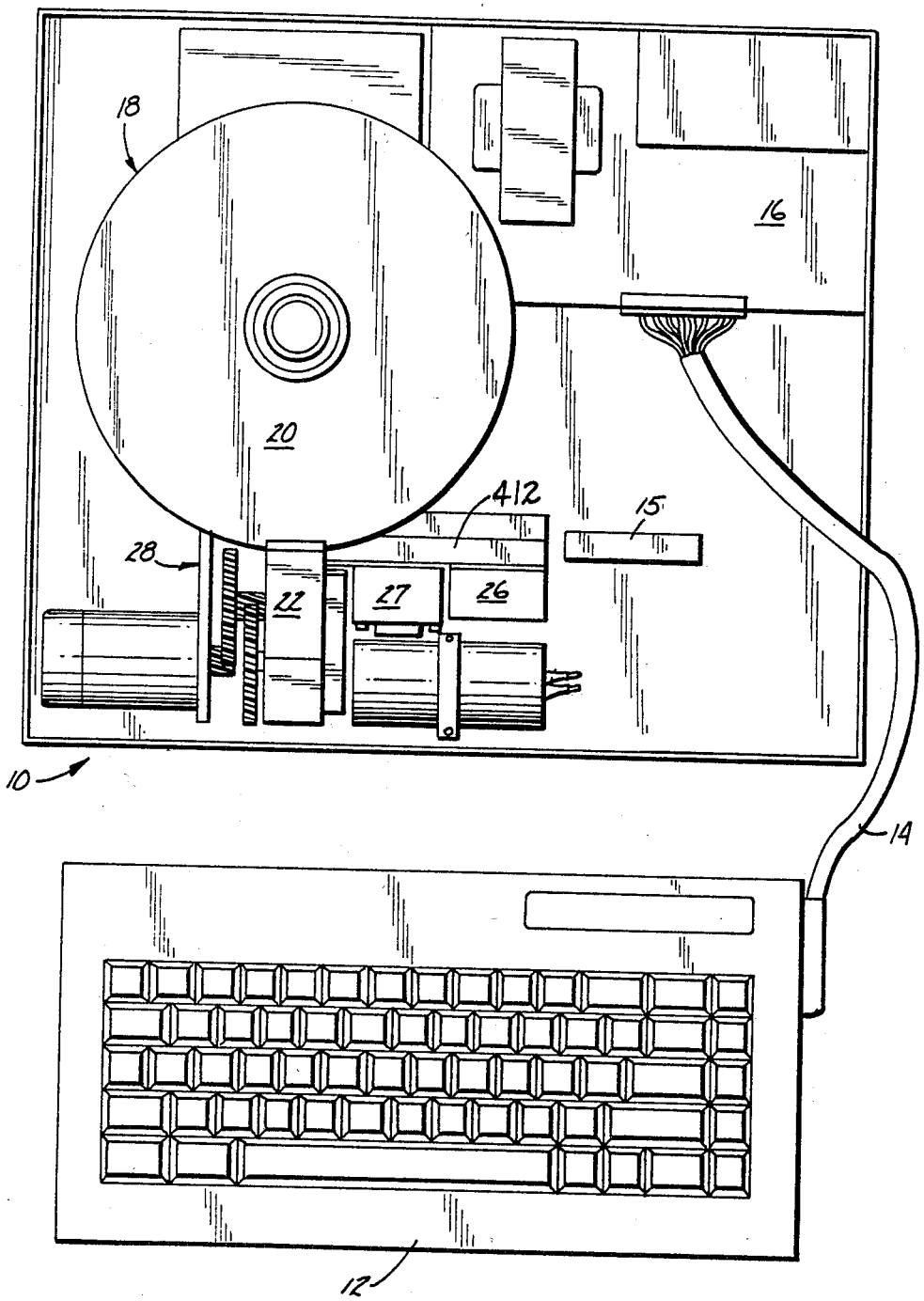
FIG. 1 is a top plan view of an environment in which this invention could be employed, namely an electronic tape writing machine.

Reference should be first made to FIG. 1 of the drawings which shows an overall environmental view of a system in which the invention is preferably employed. FIG. 1 shows an electronic tape writing machine 10 having a keyboard 12, which is connected by a cable 14 to an electronics section 16. Signals from the keyboard are interpreted by the electronics section 16 and cause the print disk positioner 18 to locate the print disk 20 in the appropriate position within the jaws of the impact printing device 22. Adjacent device 22 is a carrier tape 15 and a ribbon cassette 412 using a carbon-like material, which as advanced by the tape advance device 26 and which may be later cut by tape cutting device 28. For ease of understanding, we will refer to print mechanisms 22 and its adjacent components as the printing station.

Figure 2:
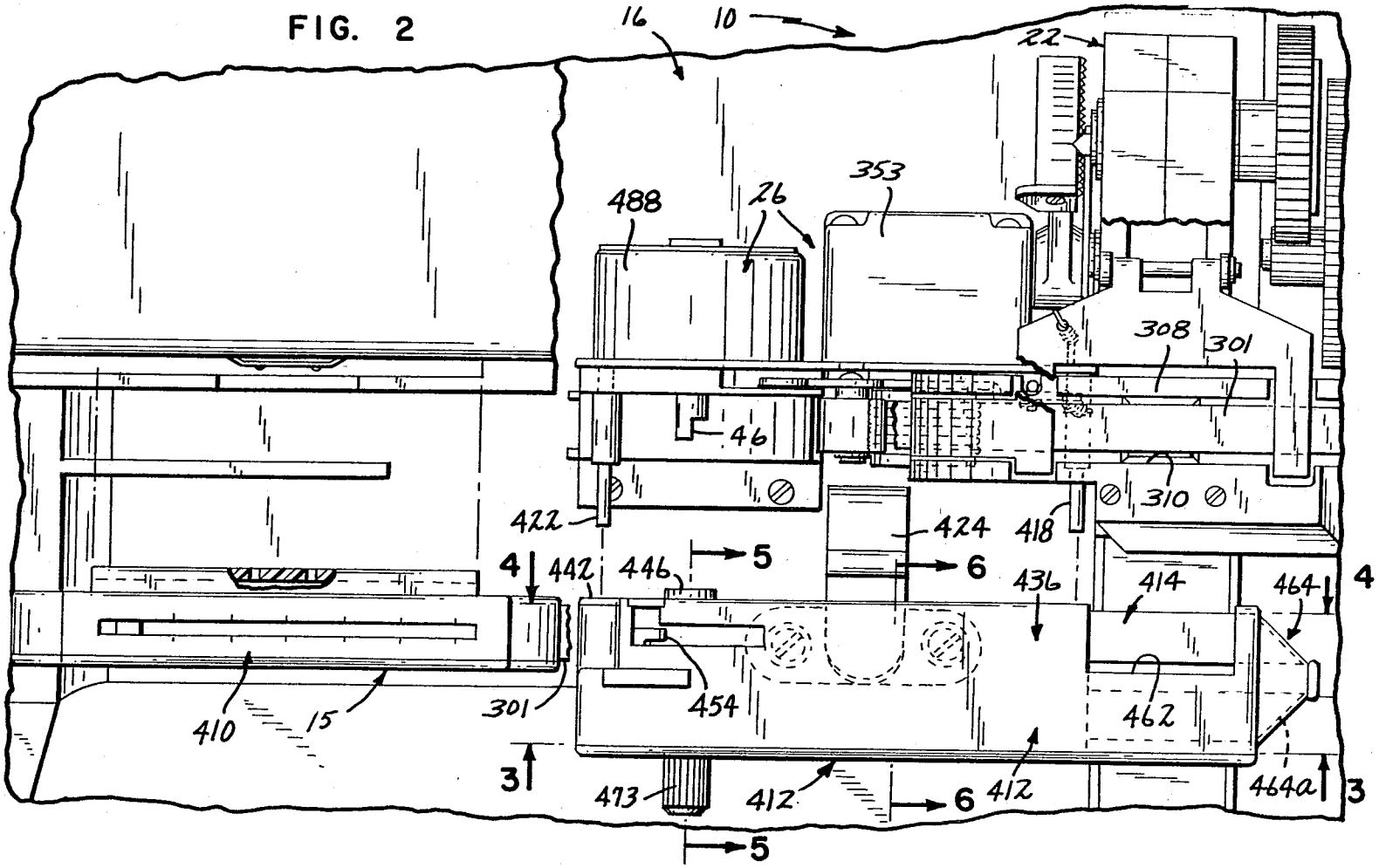
FIG. 2 is a top plan view of a portion of the machine shown in FIG. 1.

Turning to FIG. 2, there can be seen a portion of the overall system including the print station of the paper tape 301, the drive 353 for the tape 301, the tape supply spool 410 and the ribbon cassette 412. It will be appreciated that the tape supply 410 and cassette 412 are shown in their removed position and their "in use" position can be appreciated by following the dotted lines therefrom. Thus, in a completed system, tape 301 from spool 410 will reside upon plate 308 in the print station and specifically over aperture 310 where a print hammer will strike toward the tape. Overlying tape 301 is the film ribbon 414 when the cassette is in place. Atop the ribbon will be print disk 20 (not shown) and the anvil to print mechanism 22. During impact, the hammer passes through aperture 310 bringing together the print disk, film 414, and tape 301, thereby transferring the image from the print disk onto the tape by fusing a portion of the carbon-like material on the ribbon 414.

Figure 3:
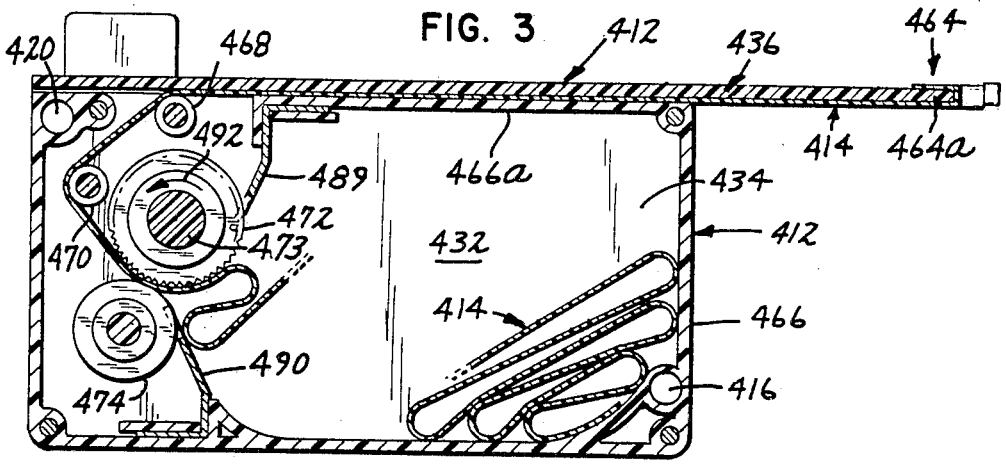
FIG. 3 is a view taken along the lines 3—3 of FIG. 2.
Figure 4:
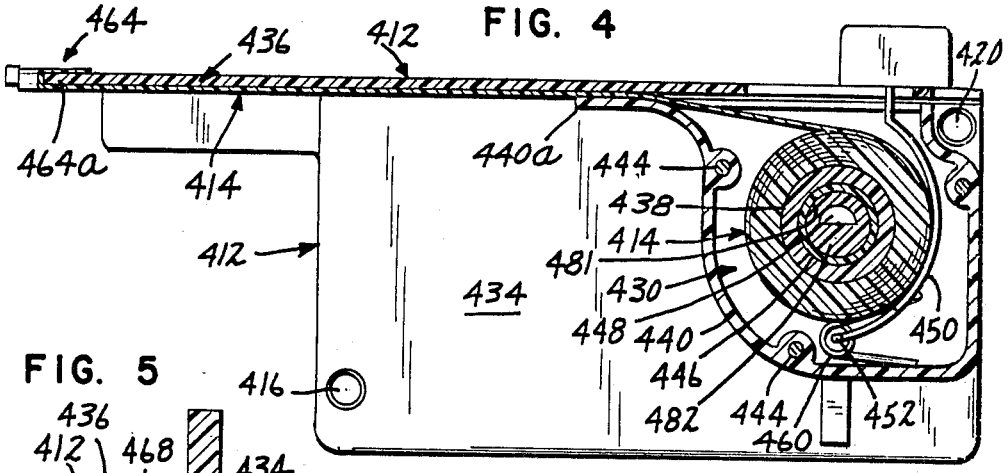
FIG. 4 is a view taken along the lines 4—4 of FIG. 2.

Cassette 412 is mounted in place at the print station by means of an aperture 416 (see FIG. 3) which receives pin 418 on the print station. Likewise, aperture 420 receives pin 422 on the print station. Finally, a spring bias member 424 mounted at the base of the print station provides a upward and inward bias force to hold the bottom portion of the cassette in contact with the print station.

For a more complete discussion of the ribbon cartridge, reference should be made to FIGS. 3–6.

Generally speaking, the preferred embodiment of the cassette includes two compartments, a supply side compartment 430, a spent ribbon compartment 432, separated by dividing wall 434 and a ribbon track 436 oriented generally orthogonally to wall 434. The unused ribbon supply reel 438 supplies ribbon to the ribbon track 436 and then back into the spent ribbon chamber 432.

Chamber 430 is bound by divider 434, a curved wall 440 projecting orthogonally therefrom and defining a perimeter boundary and a cover plate 442 shown here as translucent. The plate is affixed to the boundary wall 440 by pin fastening means 444. The spool 438 rides upon a fixed bearing 446 which is affixed to plate 434. In the center of the bearing, which is hollow, is an aperture 448 which allows communication between chambers 430 and 432.

A sensor member 450 formed in a generally semi-circular shape is attached at one end to plate 434 at a pivot point 452 located toward its lower end. Sensor 450 is likewise pivotally held by cover 442 in a similar manner. At its upper end, sensor 450 has an indicator portion 454 which extends up into a slot in member 436. The slot may be graduated to indicate the relative degree of ribbon unused. Sensor 450 is constantly biased against the outer periphery of spool 438 by means of a spring 460.

The ribbon 414 which comes off spool 438, passes between member 436 and a portion 440A of wall 440 to a point where wall 440A ends and a portion of member 436 has been deleted resulting in an aperture 462 shown most clearly in FIG. 2. In this region, the ribbon 414 is unsupported and is free to be contacted by the printing apparatus. The aperture 462 is aligned so that the ribbon 414 will be available to the printing station 22 for impacting.

The ribbon 414 continues beyond the aperture 462 and member 436 "resumes" its guidance and protection of the ribbon 414 up to the crossover portion 464 where the ribbon 414 is folded over and then under the triangular shape portion 464*a*. The ribbon 414 then follows a path to the used ribbon chamber just underneath 436.

Used ribbon chamber 432 is bound by a perimeter wall 466 whose upper portion 466A defines a passage with member 436. The ribbon 462 then passes to the rear portion of chamber 432 and comes through a pair of binding posts with bearing members 468 and 470 rotatably mounted thereon.

From there, the ribbon 414 passes through a pair of adjacent rollers 472 and 474. Roller 472 has a knurled or serrated outer periphery so as to have a high frictional contact with the ribbon 414. It also includes a central knob 473 for manually turning the roller 472.

Figure 5:
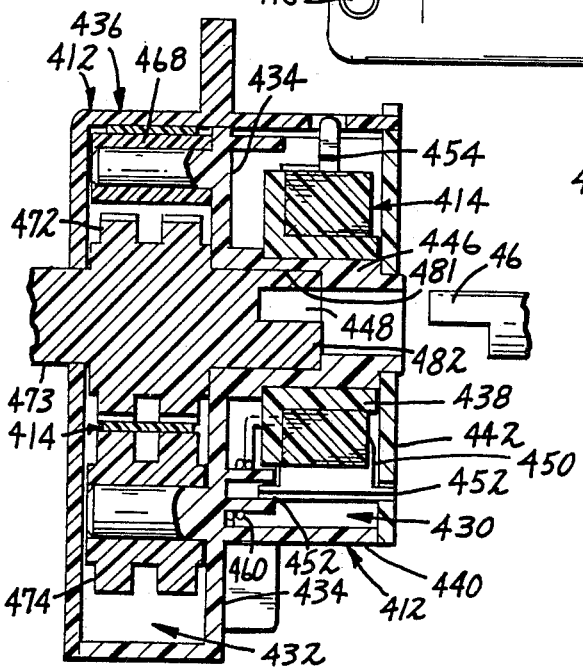
FIG. 5 is a view taken along the lines 5—5 of FIG. 2.
Figure 6:
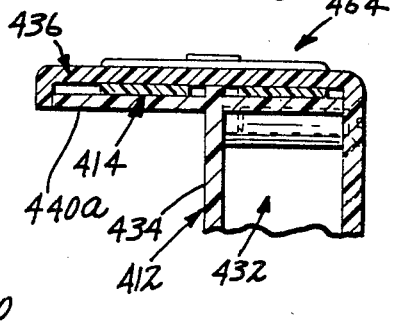
FIG. 6 is a view taken along the lines 6—6 of FIG. 2.

As seen most clearly in FIG. 5, roller 472 has an extending shaft 482 which extends through opening 481 in bearing 446 of the divider wall 434 and into chamber 430. This extending shaft 482 includes a key way 448 designed to receive a like key 46 on the power drive shaft on motor 488 shown in FIG. 2. This key 448 and extending drive shaft 482 effectively passes through chamber 430, and the supply spool 438 to drive the take-up roller 472 so that the same bearing 446 which supports spool 438 also assists in supporting shaft 482.

The ribbon 414 is biased against the knurled portions 476 of roller 472 by the bias roller 474 which is preferably made of a rubber-like material.

To prevent the spent ribbon 414 from being drawn around rollers 472 or 474, a pair of strippers 489 and 490 are biased into grooves in rollers 474 and 472 respectively and force any remaining ribbon to be peeled away from the spool during rotation. The spent ribbon 414 is then deposited in the remaining open space within chamber 432.

When the ribbon 414 is completely used and no further remains on the supply spool 438, the cassette 24 is intended to be thrown away, since the ribbon 414 is of a single strike type and cannot be reused. In the event that the ribbon 414 is not taut during use, it can be made so by simple turning of knob 473 in the counterclockwise direction indicated by arrow 492.

Although some specific embodiments of the present invention have been shown, those skilled in the art will perceive modifications which can be made without parting from the spirit of the invention. Therefore, it is intended that the scope of the present invention is dictated by the appended claims rather than by the description of the embodiment.

We claim:

1. A film ribbon cassette for a printer comprising:

(a) a casing having first, second, and third generally parallel spaced-apart non-rotating walls defining a first tape supply compartment and a second spent tape compartment;

(b) apertures in said first, second and third walls;

(c) a fixed hollow bearing extending orthogonally from said second wall into said first compartment and having its central axis aligned with the center of said apertures;

(d) a tape supply spool having an aperture sized to ride upon said fixed bearing;

(e) a shaft extending from said first compartment within said first bearing through said second compartment, through said aperture in said third wall and outside said cassette, providing a manual advancing knob outside the cassette;

(f) a takeup drive roller concentrically affixed to said shaft and located in said second compartment;

(g) a pinch roller having an axis of rotation parallel to said drive roller and cooperating with said drive roller to feed the ribbon;

(h) means for guiding ribbon from said supply spool outside of said first compartment and into said second compartment and between said rollers;

(i) driving engagement means formed at the end of said shaft within said fixed bearing for receiving and engaging a rotary drive outside said cassette which in turn drive said rollers and advance the ribbon;

(j) a pair of strippers, attached to said cassette at one end and engaging said rollers at their other ends for disengaging spent ribbon from said rollers; and (k) a ribbon supply sensor and spool engaging member which serves as a means to apply drag to said supply spool, said sensor including a generally semicircular member having an inner concave arcuate surface which directly engages an arc formed on the outer peripheral surface of said ribbon supply spool, said member being affixed at one end to said cassette and including means for biasing said member against said supply spool to provide drag opposing rotation thereof.

2. A film ribbon cassette according to claim 1 wherein said semicircular spool engaging member has one free end and wherein that end includes a planar indicator member and wherein said casing includes a slot sized to receive said indicator member and having calibrations thereon, whereby the degree of tape supply can be ascertained by inspecting the calibrations.

* * * * *